United States Patent [19]

Schumacher et al.

[11] Patent Number: 4,946,644

[45] Date of Patent: Aug. 7, 1990

[54] AUSTENITIC STAINLESS STEEL WITH IMPROVED CASTABILITY

[75] Inventors: William J. Schumacher, Monroe; James A. Daniels, Loveland, both of Ohio

[73] Assignee: Baltimore Specialty Steels Corporation, Baltimore, Md.

[21] Appl. No.: 319,400

[22] Filed: Mar. 3, 1989

[51] Int. Cl.[5] ..... C22C 38/58; C22C 39/26

[52] U.S. Cl. ..... 420/56; 148/327; 420/58; 420/59

[58] Field of Search ..... 420/56, 58, 59; 148/327

[56] References Cited

U.S. PATENT DOCUMENTS

| | | | |
|---|---|---|---|
| 3,615,366 | 10/1971 | Allen | 75/125 |
| 3,912,503 | 10/1975 | Schumacher et al. | 420/56 |
| 3,940,266 | 2/1976 | Goller et al. | 75/128 A |
| 3,989,474 | 11/1976 | Goller et al. | 29/193 |
| 4,514,236 | 4/1985 | Cook et al. | 148/327 |

FOREIGN PATENT DOCUMENTS

| | | |
|---|---|---|
| 106620 | 9/1978 | Japan . |
| 508619 | 7/1939 | United Kingdom . |
| 995068 | 6/1965 | United Kingdom . |
| 1331770 | 9/1973 | United Kingdom . |
| 2075550 | 4/1984 | United Kingdom . |

OTHER PUBLICATIONS

Thompson, Trans. ASM 52 (1960) 853–54.

Riedgrich et al, Translation from Berg.4.Hüttenmänische Monatshefte 108 (1968) 1–8, Whittenberger et al. Trans. Aime (Jul. 1957), p. 889.

"Structure and Properties of Corrosion and Wear Resistant Cr–Mn–N Steels", *Metallurgical Transactions, pp. 847–855, May 1987, Lenel.*

"Microstructure–Composition Relationships and Ms Temperatures in Fe–Cr–Mn–N Alloys", *Metallurgical Transactions,* May 1987, pp. 767–775, UR Lenel.

"Nickelless Austenitic Stainless Steel", *Nippon Steel Technical Report,* No. 12, Dec. 1978, Arakawa et al., pp. 10–19.

*Primary Examiner*—Upendra Roy

*Attorney, Agent, or Firm*—L. A. Fillnow; R. J. Bunyard; R. H. Johnson

[57] ABSTRACT

An austenitic Fe-Cr-Mn-N stainless steel is characterized by a combination of improved castability in terms of yield and speed and the development of excellent strength and ductility levels in the cold worked condition. The low alloy stainless steel consists essentially of, in weight percent, from about 13% to 17% chromium, about 8% to 12% manganese, about 0.05% to 0.2% carbon, about 0.15% to 0.23% nitrogen, about 1.5% maximum nickel, about 1% maximum molybdenum, about 1% maximum silicon, about 1% maximum copper and balance essentially iron. The steel composition is particularly suited for cold-drawn wire which develops an ultimate tensile strength of at least about 250 ksi with elongations of at least about 10%.

11 Claims, No Drawings

AUSTENITIC STAINLESS STEEL WITH IMPROVED CASTABILITY

BACKGROUND OF THE INVENTION

The present invention relates Fe-Cr-Mn-N stainless steels with reduced levels of Ni which develop high levels of strength and have improved castability.

Due to the cost of nickel, a considerable interest has developed to lower nickel in austenitic stainless steels. The elements normally used to replace nickel include manganese, nitrogen, carbon and copper. The balance between these nickel replacement elements is important to develop the desired mechanical properties in addition to maintaining an austenitic structure.

The composition balance for Fe-Cr-Mn-N steels depends on the need for weldability, corrosion resistance, toughness, wear, strength and other properties. Regardless of the desired properties, the composition must be essentially austenite in the annealed, cast or unworked condition.

U.S. Pat. No. 3,989,474 (G. N. Goller et al.) discloses an austenitic stainless steel article consisting essentially of 0.06 to 0.12% carbon, 11 to 14% manganese, 15.5 to 20% chromium, 1.1 to 2.5% nickel, 0.2 to 0.38% nitrogen, 1% maximum silicon and balance iron. The steels are characterized by high strength levels after working and they remain substantially fully austenitic.

British Patent No. 2,075,550 (Douthett et al.) is an inexpensive austenitic stainless steel balanced for high work hardening and good-abrasion resistance. The composition range disclosed consists essentially of 0.015 to 0.10% carbon, 6 to 10% manganese, 13 to 20% chromium, 1 to 3% nickel, 0.15 to 0.22% nitrogen, 2% maximum silicon and balance iron. The desired properties are developed by controlling the austenite stability to obtain deformation martensite during cold reduction.

Fulmer Research Laboratories Ltd. has done work recently to adjust the balance in Fe-Cr-Mn-N steels for applications in hard-rock mines. The stability of the austenite was reduced and the martensite start temperatures were investigated by Fulmer and reported in *Metallurgical Transactions*, Volume 18A, May 1987, pages 767–775. The steels investigated were 8–12% Cr, 0–10% Mn, 0–0.6% N and about 0.02% max C. The nitrogen was introduced by high temperature nitriding. A companion Fulmer paper was published in the same issue of *Metallurgical Transactions* which discussed the properties of related steels up to 0.049% carbon (pages 847–855).

The prior work by others has not dealt with the problems which develop during casting of an Fe-Cr-Mn-N alloy. The composition has not been balanced for improving castability. The present invention has discovered a composition which has improved the strength and ductility during high temperature continuous casting for improved yields. The steels must also be balanced to avoid thermal transformation to martensite and have a high work hardening rate which provides high tensile strengths and improved ductility compared to prior alloys after cold working. The stainless steels of the past could not provide these properties with a low-cost austenitic stainless steel composition.

BRIEF SUMMARY OF THE INVENTION

The present invention relates to an austenitic stainless steel composition and articles manufactured from the steel composition. The stainless steels are essentially austenitic without requiring a significant nickel addition.

The steels of the invention consist essentially of:
about 13% to about 17% chromium;
about 8% to about 12% manganese;
about 0.05% to about 0.2% carbon;
about 0.15% to about 0.23% nitrogen;
about 1.5% maximum nickel;
about 1% maximum silicon;
about 1% maximum copper;
about 1% maximum molybdenum; and
balance essentially iron.

Any substantial departure from the ranges set forth above results in a disturbance of the composition balance with a resulting sacrifice in one or more of the desired characteristics.

Nitrogen solubility is critically controlled to maximize the amount of nitrogen without developing porosity problems.

Carbon is added within the present ranges to provide the desired strength during continuous casting.

Manganese is adjusted to high levels which reduce nitrogen porosity, maintain a stable austenitic structure and develop the desired work hardening characteristics.

Chromium is reduced slightly from normal austenitic stainless steels to enable a composition balance which is less expensive and also insure the alloy is free from delta ferrite.

It is a principal object of the present invention to provide an Fe-Cr-Mn-N alloy which exhibits improved strength and ductility immediately after solidification to provide improved castability.

An additional principal object of the present invention is to provide a low-cost austenitic stainless steel which has good ductility and high ultimate tensile strength after cold working and also resists thermal transformation to martensite.

A further object of the present invention is to improve the yields and casting speeds during continuous casting normally associated with Fe-Cr-Mn-N alloy production.

A still further object is to provide cold-worked articles, such as wire, which develop improved levels of strength and ductility due to the improved work hardening characteristics of the alloy.

The above objects and features of the present invention, and others, will become apparent upon consideration of the detailed description.

DETAILED DESCRIPTION OF THE PREFERRED EMBODIMENT

In accordance with the invention, there is provided an austenitic stainless steel having improved castability, a high work hardening rate and an austenite stability which avoids thermal transformation to martensite. In weight percent, the steel consists essentially of about 13% to 17% chromium, about 8% to 12% manganese, about 0.05% to 0.2% carbon, about 0.15% to 0.23% nitrogen, about 1.5% maximum nickel and balance essentially iron. Silicon, copper and molybdenum may each be present up to about 1% maximum. The percentage ranges and proportioning among the essential elements chromium, manganese, carbon, nitrogen and nickel are critical in every respect and departure therefrom results in loss of one or more of the desired properties.

A more preferred composition for the steel of the invention (in weight percent) is as follows:
13.5 to 15.5% Cr;
9 to 11% Mn;
0.07 to 0.12% C;
0.16 to 0.22% N;
1.5% maximum Ni;
1% maximum Si;
1% maximum Mo;
1% maximum Cu; and
balance essentially Fe.

The compositions of the various alloys tested are set forth in Table 1 below and the mechanical properties of the alloys are set forth in Tables 2–4.

Steels A–D are four air induction melted laboratory heats having a base composition aim, in weight percent, of 14% Cr, 10% Mn and 0.11% C. Nitrogen was varied to establish the solubility limit for the alloy. Steel D with 0.23% N had a porosity problem and was used to determine the upper limit for the steels of the invention. Increases in Mn and Cr to Steel D may have provided the increased solubility level and still had a composition within the ranges for the steel of the invention. Since Steel D was not balanced properly and had nitrogen porosity problems, it is not considered a steel of the invention. Variations in Mo were studied to determine if Mo added strength during continuous casting. The effects of Mo were not conclusive.

Steels A, B and C are steels of the invention and produced sound castings with no N porosity.

Steel E is a commercial size heat of the invention used to evaluate the continuous castability of the invention. Steel F represents the composition used prior to the invention by the assignee which is a modification of GB 2,075,550. Steel F has difficulties in being continuously cast.

Table 2 is a summary of the Gleeble results which evaluated samples (4 inches in length, 0.25 inches in diameter) sectioned 0.25 inches from the surface of each ingot. The samples were oriented transverse to the primary dendrite orientation. These ultimate tensile strengths at 2200° F. to 2500° F. provide an indication of its castability strength. A Gleeble test is a laboratory simulation which indicates strength and ductility in casting conditions. The Gleeble Machine is produced by Duffers & Associates. The improved castability of the steels of the invention was a great surprise based on prior experience.

Table 3 also lists Gleeble test results which indicate the % reduction in area during casting conditions as a measure of its ductility. It is evident from the data that the steels of the invention exhibit a marked superiority in ductility during continuous casting.

The remaining materials from each steel casting were hot rolled from 2200° F. to a thickness of 0.12 inches. After subsequent cold rolling to intermediate gauge and annealing, the materials were cold rolled to 0.04 inches with reductions up to 50%. Results for the mechanical properties vs. % cold reduction are reported in Table 4. The work hardening characteristics of the steels of the invention are particularly evident in the ultimate tensile strengths. The Steels of the invention have improved ductility as measured by % elongation when given large reductions.

The results from trials are considered successful even if the properties are substantially the same because the lower cost of alloying the steels of the invention makes the material commercially attractive. The higher ultimate strengths developed could also permit a reduction in thickness or diameter in the finished product to develop a cost savings.

It is important to note that the commercial size heat for Steel E was able to be horizontally continuous cast at speeds 15% higher than for Steel F. This was a real surprise in productivity and also resulted in yields 20% higher than normal (melt to cast section). The improvement in tensile ductility at casting temperatures as shown in Table 3 is believed largely responsible for this dramatic improvement in castability.

Nickel is well known for its role as an austenite former. It is, however, an expensive alloying element. Nickel also has an adverse effect on work hardening rate and the development of high strength levels. In view of this, nickel is restricted in the present invention to levels below 1.5%. A preferred range is 0.4% to 1.3% which allows the use of high nickel scrap in melting and also provides austenite forming benefits. Lower levels of nickel may be used if balanced with the other elements in the alloy.

Manganese is essential as a partial replacement for nickel to form austenite and also stabilize austenite. Manganese also functions to hold nitrogen in solution and impart toughness. The broad range of manganese in the steels of the invention is about 8% to about 12% and preferably about 9% to about 11%. Levels of manganese above 12% tend to reduce the work hardening rate and the strength levels. Higher manganese levels would increase the melting costs, lower the general corrosion resistance and require further alloy adjustments to maintain the composition balance. High manganese levels may also contribute to excessive refractory wear during melting. Manganese levels within the range of 8% to 12% has a beneficial influence on the formation of epsilon martensite during cold working rather than alpha prime martensite. Epsilon has lower stacking fault energy which provides better ductility due to the slip mechanism. A preferred range of manganese is about 9% to 11%.

Nitrogen is essential for its strong austenite forming potential and obtaining high levels of strength due to solid solution strengthening. A minimum level of 0.15% is required and preferably a minimum of 0.16% is present. A maximum of 0.23% should be observed to balance the composition with respect to the austenite and ferrite forming tendencies. A preferred upper limit of 0.22% is suggested to avoid the possibility of gassy heats. Nitrogen contents between 0.15% to 0.23% help to reduce the levels of nickel required to balance the alloy. Optimum results have been obtained for martensite transformation (as denoted in Table 4) for 0.18 to 0.21% nitrogen. Martensite transformation is known to promote stress cracking in highly cold worked metastable austentic stainless steels.

Carbon is also a strong austenite former and is used to replace nickel in this role. Carbon is also very important in developing high tensile and yield strengths. In the steels of the present invention carbon is present from 0.05% to 0.12% and preferably 0.07% to 0.12%. The optimum level of carbon is 0.09% to 0.11%. Carbides, which may be difficult to dissolve during annealing, must be controlled to avoid an adverse effect on corrosion resistance. Carbon and nitrogen are both interstitial elements which contribute strongly to the strength of the alloy. It is important that the sum of carbon and nitrogen, however, be controlled for good ductility. The sum of carbon plus nitrogen is preferably less than 0.35%. Carbon provides improved strength during continuous casting.

Chromium is a critical element in the composition balance. A minimum level of about 13% is required to provide corrosion resistance and in combination with manganese, hold nitrogen in solution. In combination with the existing levels of carbon, nitrogen, nickel and manganese, levels of chromium above 17% cannot be tolerated and provide the composition balance. A preferred range for chromium is about 13.5% to about 15.5%.

Any molybdenum or copper present as an impurity or purposeful addition should be limited to a maximum of about 1% and preferably about 0.75% maximum for each element. Copper does act as a nickel substitute and molybdenum does improve the castability slightly but is a ferrite former.

Silicon is limited to a maximum of about 1% and preferably about 0.75% maximum because it is a potent ferrite former.

Any one or more of the elements of the steels of the invention may be claimed with a preferred or more preferred range in combination with a broad range for any one or more remaining elements set forth above.

TABLE 1

| | Steel Compositions (In Weight %) | | | | | | | | |
|---|---|---|---|---|---|---|---|---|---|
| Steel | C | Mn | P | S | Si | Cr | Ni | Mo | N |
| A* | .11 | 9.8 | .024 | .004 | .50 | 14.1 | .48 | <.01 | .16 |
| B* | .11 | 9.7 | .024 | .004 | .45 | 14.2 | .44 | <.01 | .20 |
| C* | .11 | 9.6 | .024 | .004 | .41 | 14.2 | .44 | .41 | .20 |
| D** | .11 | 9.9 | .024 | .004 | .44 | 14.1 | .42 | .54 | .23 |
| E* | .10 | 9.71 | .024 | .004 | .36 | 14.49 | 1.10 | .51 | .20 |
| F*** | .095 | 8.0 | .025 | .003 | .50 | 15.8 | 2.45 | .55 | .20 |

*Steels of the invention
**Nitrogen porosity problem
***GB 2,075,550

TABLE 2

| | | Gleeble Test Results | | | | | | |
|---|---|---|---|---|---|---|---|---|
| | | Ultimate Tensile Strength At Temperature (°F.) | | | | | | |
| Heat | % N | 2200 | 2250 | 2300 | 2350 | 2400 | 2450 | 2500 |
| A* | .16 | 9.9 | | 8.4 | 7.5 | 5.9 | 0.3 | |
| C* | .20 | 11.0 | | 8.9 | 7.7 | 5.6 | 0.3 | |
| D | .23 | | | | 7.0 | 6.3 | 0.3 | |
| F*** | | | 9.2 | 8.9 | 7.3 | 5.5 | 0.5 | |

*Steels of the invention
***GB 2,075,550

TABLE 3

| | | Gleeble Test Results | | | | | | |
|---|---|---|---|---|---|---|---|---|
| | | % Reduction In Area At Temperature (°F.) | | | | | | |
| Heat | % N | 2200 | 2250 | 2300 | 2350 | 2400 | 2450 | 2500 |
| A* | .16 | 81 | | 79 | 69 | 58 | 0 | |
| C* | .20 | 84 | | 80.0 | 74 | 43 | 0 | |
| D | .25 | | | | — | 30 | 0 | |
| F*** | | | 76 | 70 | 63 | 35 | 0 | |

*Steels of the invention
***GB 2,075,550

TABLE 4

| Mechanical Properties vs. % Cold Reduction | | | | | | | |
|---|---|---|---|---|---|---|---|
| | | 0.2% Yield Strength (ksi) | | | | | |
| Steel | % N | Ann. | 10% | 20% | 30% | 40% | 50% |
| A* | .16 | 52.3 | 82.5 | 111.7 | 141.1 | 180.1 | 237.4**** |
| B* | .20 | 59.2 | 92.9 | 113.3 | 138.6 | 165.4 | 207.0**** |
| C* | .20 | 60.1 | 89.7 | 118.0 | 144.7 | 180.0 | 209.9 |
| D | .23 | 59.4 | 83.5 | 112.0 | 138.3 | 165.6 | 204.8 |
| F | — | 57 | 96 | 122 | 152 | 170 | 181 |
| | | Ultimate Tensile Strength (ksi) | | | | | |
| Steel | % N | Ann. | 10% | 20% | 30% | 40% | 50% |
| A* | .16 | 145.4 | 136.5 | 196.9 | 223.1 | 246.4 | 271.0**** |
| B* | .20 | 152.4 | 158.5 | 190.9 | 232.0 | 257.5 | 274.5**** |
| C* | .20 | 146.6 | 164.3 | 199.9 | 233.4 | 257.6 | 264.9 |
| D | .23 | 131.6 | 161.1 | 186.6 | 207.0 | 225.0 | 256.7 |
| F | — | 122 | 145 | 176 | 184 | 201 | 219 |
| | | % Elongation | | | | | |
| Steel | % N | Ann. | 10% | 20% | 30% | 40% | 50% |
| A* | .16 | 36.0 | — | 13.0 | 16.5 | 15.0 | 10.0**** |
| B* | .20 | 45.5 | 21.0 | 12.0 | 16.0 | 14.0 | 11.5**** |
| C* | .20 | — | 23.5 | 11.5 | 16.5 | 14.0 | 13.0 |
| D | .23 | 47.0 | 32.0 | 15.0 | 16.5 | 13.5 | 9.0 |
| F | — | 56 | 38 | 25 | 21 | 17 | 8 |
| | | Hardness | | | | | |
| Steel | % N | ($R_B$) Ann. | 10% | ($R_C$) 20% | 30% | 40% | 50% |
| A* | .16 | 91.0 | 32.5 | 42.5 | 47.5 | 50.5 | 53.5**** |
| B* | .20 | 94.5 | 32.0 | 41.4 | 48.0 | 51.0 | 53.5**** |
| C* | .20 | 93.5 | 32.0 | 43.0 | 48.1 | 51.0 | 53.5 |
| D | .23 | 92.5 | 25.5 | 40.0 | 46.0 | 48.0 | 53.0 |
| F | — | 92B | 30C | 39C | 41C | 44C | 46C |
| | | % Magnetism | | | | | |
| Steel | % N | Ann. | 10% | 20% | 30% | 40% | 50% |
| A* | .16 | 0 | 1.25 | 11.5 | 18 | 28 | >30**** |
| B* | .20 | 0 | 1 | 7 | 17 | 24.5 | 24.5**** |
| C* | .20 | 0 | 1 | 8 | 12.5 | 20 | 26 |
| D | .23 | 0 | 0.5 | 4 | 11.5 | 12.5 | 22.5 |

*Steels of the invention
****Maximum attainable cold work was 45%

The steels of the invention are produced at a lower cost through savings in expensive alloying elements, improved yields and improved casting rates. Steels of the invention in the form of hot-rolled sheet, strip, bar, rod, wire and the like or cold-worked articles in the form of sheet, strip, wire or the like obtain the various objects and advantages hereinbefore set forth. Cast articles having the composition of the present invention also possess excellent properties. The articles of the present invention may be easily welded or used in the fabrication of a host of articles of ultimate use.

It will be understood that sulphur, phosphorus and other residuals may be present in the steels of the invention. The levels for these residuals are typically below about 0.05%.

Since many modifications of the embodiments of the invention will occur to those skilled in the art to which the invention relates, it is to be understood that all matter described herein is to be interpreted as illustrative and not by way of limitation. Wire articles include weld wire and powder articles include the powder having the composition of the invention and finished articles produced from the powder.

We claim:

1. An austenitic stainless steel of high work hardening rate, high stability against thermal martensite transformation and improved castability, said steel consisting essentially of, in weight percent:

about 13.5% to about 15.5% chromium;
about 8% to 12% manganese;
about 0.05% to 0.2% carbon;

about 0.15% to 0.22% nitrogen;
about 1.5% maximum nickel; and
balance essentially iron.

2. The steel according to claim 1 including:
up to about 1% silicon;
up to about 1% copper; and
up to about 1% molybdenum.

3. An austenitic stainless steel according to claim 2 consisting essentially of, in weight percent:
about 13.5% to 15.5% chromium;
about 9% to 11% manganese;
about 0.07% to 0.12% carbon;
about 0.16% to 0.22% nitrogen;
about 0.4% to 1.3% nickel; and
balance essentially iron.

4. Stainless steel sheet, strip, wire, bar, rod and the like in the hot-rolled annealed condition substantially free of delta ferrite and of high strength consisting essentially of, in weight percent:
about 13.5% to about 15.5% chromium;
about 8% to 12% manganese;
about 0.05% to 0.2% carbon;
about 0.15% to 0.22% nitrogen;
about 1.5% nickel; and
balance essentially iron.

5. Stainless steel sheet, strip, wire, bar, rod and the like according to claim 4 consisting essentially of, in weight percent:
about 13.5% to 15.5% chromium;
about 9% to 11% manganese;
about 0.07% to 0.12% carbon;
about 0.16% to 0.22% nitrogen;
about 0.4% to 1.3% nickel;
about 1% maximum molybdenum;
about 1% maximum silicon;
about 1% maximum copper; and
balance essentially iron.

6. Stainless steel sheet, strip, wire and the like in the cold-worked and cold-worked annealed condition substantially free of delta ferrite having an ultimate tensile strength above 250 ksi and at least about 10% elongation consisting essentially of, in weight percent:
about 13.5% to about 15.5% chromium;
about 8% to 12% manganese;
about 0.05% to 0.2% carbon;
about 0.15% to 0.22% nitrogen;
about 1.5% nickel; and
balance essentially iron.

7. Cold-rolled stainless steel sheet, strip, wire and the like in the cold-worked and cold-worked annealed condition according to claim 6 consisting essentially of, in weight percent:
about 13.5% to 15.5% chromium;
about 9% to 11% manganese;
about 0.08% to 0.12% carbon;
about 0.17% to 0.21% nitrogen;
about 0.5% to 1.3% nickel;
about 1% maximum molybdenum;
about 1% maximum silicon;
about 1% maximum copper; and
balance essentially iron.

8. Stainless steel cast articles substantially free of delta ferrite after annealing and of high strength consisting essentially of, in weight percent:
about 13.5% to about 15.5% chromium;
about 8% to 12% manganese;
about 0.05% to 0.2% carbon;
about 0.15% to 0.22% nitrogen;
about 1.5% nickel; and
balance essentially iron.

9. Stainless steel cast articles according to claim 8 consisting essentially of, in weight percent:
about 13.5% to 15.5% chromium;
about 9% to 11% manganese;
about 0.07% to 0.12% carbon;
about 0.16% to 0.22% nitrogen;
about 0.4% to 1.3% nickel;
about 1% maximum molybdenum;
about 1% maximum silicon;
about 1% maximum copper; and
balance essentially iron.

10. Stainless steel powder articles consisting essentially of, in weight percent:
about 13.5% to about 15.5% chromium;
about 8% to 12% manganese;
about 0.05% to 0.2% carbon;
about 0.15% to 0.22% nitrogen;
about 1.5% nickel; and
balance essentially iron.

11. Stainless steel powder articles according to claim 10 consisting essentially of, in weight percent:
about 13.5% to 15.5% chromium;
about 9% to 11% manganese;
about 0.07% to 0.12% carbon;
about 0.16% to 0.22% nitrogen;
about 0.4% to 1.3% nickel;
about 1% maximum molybdenum;
about 1% maximum silicon;
about 1% maximum copper; and
balance essentially iron.

* * * * *